US008157053B1

(12) United States Patent
Lameiro

(10) Patent No.: US 8,157,053 B1
(45) Date of Patent: Apr. 17, 2012

(54) STOOL

(76) Inventor: Gabriel Lameiro, Johnston, RI (US)

( * ) Notice: Subject to any disclaimer, the term of this patent is extended or adjusted under 35 U.S.C. 154(b) by 353 days.

(21) Appl. No.: 12/471,563

(22) Filed: May 26, 2009

Related U.S. Application Data

(60) Provisional application No. 61/058,240, filed on Jun. 3, 2008.

(51) Int. Cl.
*E04G 3/28* (2006.01)

(52) U.S. Cl. ..... 182/36; 182/222; 182/223; 182/33; 182/35

(58) Field of Classification Search ..... 182/39, 182/84, 85, 207, 36, 88, 188, 211, 93, 83, 182/33, 35, 222, 223; 297/143, 138, 147; 312/235.1, 235.3
See application file for complete search history.

(56) References Cited

U.S. PATENT DOCUMENTS

| | | | | | |
|---|---|---|---|---|---|
| 423,962 | A | | 3/1890 | Smith | |
| 553,108 | A | | 1/1896 | Davison | |
| 644,048 | A | | 2/1900 | Andre | |
| 695,406 | A | * | 3/1902 | Lynn | 104/108 |
| 759,335 | A | * | 5/1904 | Wheeland | 182/12 |
| 771,673 | A | | 10/1904 | Shumaker | |
| 907,401 | A | * | 12/1908 | Prouty | 182/39 |
| 907,402 | A | * | 12/1908 | Prouty | 182/194 |
| 1,048,596 | A | * | 12/1912 | Sedaj | 108/69 |
| 1,090,803 | A | * | 3/1914 | Van Brown | 182/39 |
| 1,452,076 | A | * | 4/1923 | Howard | 182/39 |
| 1,973,628 | A | * | 9/1934 | Hindle | 312/235.1 |
| 1,974,016 | A | * | 9/1934 | Doe | 42/126 |
| 2,273,124 | A | * | 2/1942 | McDaniels | 182/39 |
| 2,581,488 | A | | 1/1952 | Keltner et al. | |
| 2,743,861 | A | | 5/1956 | Mattis et al. | |
| 2,858,056 | A | | 10/1958 | Ownby | |
| 2,956,617 | A | * | 10/1960 | Bruderer et al. | 297/141 |
| 3,481,429 | A | | 12/1969 | Gaede | |
| 3,709,159 | A | * | 1/1973 | Oglesby, Jr. | 108/44 |
| 4,009,903 | A | * | 3/1977 | Manspeaker | 297/14 |
| 4,232,759 | A | * | 11/1980 | Jacobs | 182/39 |
| 4,440,264 | A | * | 4/1984 | Knoke et al. | 182/126 |
| 4,803,930 | A | * | 2/1989 | Crocoli | 108/48 |
| 5,085,290 | A | | 2/1992 | Guirlinger | |
| 5,131,492 | A | | 7/1992 | Caminiti et al. | |
| D358,263 | S | * | 5/1995 | Yoder, Jr. | D6/370 |

(Continued)

FOREIGN PATENT DOCUMENTS

| | | |
|---|---|---|
| JP | 1312192 | 12/1989 |

*Primary Examiner* — Darnell Jayne
*Assistant Examiner* — Johnnie A Shablack
(74) *Attorney, Agent, or Firm* — Salter & Michaelson

(57) ABSTRACT

A closet stool for use in providing access by a user to items stored in the closet and including a pair of support members each including a substantially horizontally disposed leg having inner and outer ends and a pair of brackets each for supporting an inner end of the respective substantially horizontally disposed legs from an inner wall of the closet with the legs extending in parallel and spaced from each other. The pair of support members further include a pair of substantially vertically disposed post members each having upper and lower ends. The upper end of each post member is for coupling with the outer end of a respective leg. The lower end of each post member is for resting on a floor surface of the closet. A foot support pad extends between and is supported by the legs.

2 Claims, 13 Drawing Sheets

U.S. PATENT DOCUMENTS 5,655,459 A * 8/1997 O'Connor et al. ..... 108/48
5,673,968 A * 10/1997 Ponzio ..... 297/143
5,697,470 A 12/1997 Carle
6,039,403 A * 3/2000 Hargroder ..... 297/440.24
6,161,486 A * 12/2000 Boots ..... 108/48
6,681,415 B1 * 1/2004 Gallo ..... 4/560.1
6,729,685 B1 * 5/2004 Ebalobor ..... 297/14
D495,506 S * 9/2004 Self et al. ..... D6/362
6,883,645 B2 * 4/2005 Kieffer et al. ..... 182/195
6,948,588 B1 * 9/2005 Chustak ..... 182/97
6,971,711 B1 12/2005 Gast
D536,889 S * 2/2007 Self et al. ..... D6/362
7,686,134 B1 * 3/2010 Harris ..... 182/200
7,716,757 B2 * 5/2010 Sumpton et al. ..... 4/621
2004/0251080 A1 * 12/2004 Kalos ..... 182/35
2010/0019468 A1 * 1/2010 Price ..... 280/165

* cited by examiner

STOOL

RELATED CASES

Priority for this application is hereby claimed under 35 U.S.C. §119(e) to commonly owned U.S. Provisional Patent Application No. 61/058,240 which was filed on Jun. 3, 2008 and which is incorporated by reference herein in its entirety.

FIELD OF THE INVENTION

The present invention relates in general to an improved stool construction. More particularly, the present invention relates to a universal stool construction that can be readily used preferably in a closet or the like.

BACKGROUND OF THE INVENTION

There are various types of stools and ladders that are available in the public. When putting items in or retrieving items from a closet, or the like storage area, it is typical to use a step stool or short ladder arrangement for this purpose. Most of these are used for providing additional access to items that are over head in the closet. However, there does not presently exist a stool arrangement in which the stool can be readily moved between a storage and use position and moreover, can be moved preferably so as to be relocatable in different positions in the closet.

Accordingly, it is an object of the present invention to provide an improved stool construction and one that is particularly adapted for use in a closet or the like.

Another object of the present invention is to provide a closet stool that has universal use as far as coverage of the entire area of the closet is concerned.

A further object of the present invention is to provide an improved closet stool construction that is characterized by having a storage position and a use position, and furthermore has the ability to slide sideways in the closet to cover the entire closet area.

Still another object of the present invention is to provide an improved closet stool that is relatively simple in construction, easy to assemble and use, and that is relatively inexpensive to manufacture.

SUMMARY OF THE INVENTION

To accomplish the foregoing and other objects, features and advantages of the present invention there is provided a closet stool for use in providing access by a user to items stored in the closet. The closet stool comprises a pair of support members each including a substantially horizontally disposed leg having inner and outer ends and a pair of brackets each for supporting an inner end of the respective substantially horizontally disposed legs from an inner wall of the closet with the legs extending in parallel and spaced from each other. The pair of support members further includes a pair of substantially vertically disposed post members each having upper and lower ends. The upper end of each post member is for coupling with the outer end of a respective leg while the lower end of each post member is for resting on a floor surface of the closet. A foot support pad extends between and is supported by the legs.

In accordance with another embodiment of the present invention there is provided a closet stool for use in providing access by a user to items stored in the closet with the closet stool comprising a pair of support members each having a substantially right angle construction including a substantially horizontally disposed leg having inner and outer ends and a pair of substantially vertically disposed post members each having upper and lower ends with the upper end of each substantially vertically disposed post member engaged with an outer end of the substantially horizontally disposed leg to form the right angle construction. The lower end of each substantially vertically disposed post member is for resting on a floor surface of the closet. A foot support pad extends between and is supported by the legs. The inner ends of the substantially horizontally disposed leg is supported for movement in a direction that is sideways of the closet and the foot support member is supported for movement in a direction that is orthogonal to the direction of movement of the legs.

In accordance with other aspects of the present invention the substantially horizontally disposed leg is constructed of a pipe member having two telescoping sections that enable the support members to be slid in a direction in and out of the closet; the foot support pad is also slideable on the support members in a direction in and out of the closet; the foot support pad includes support loops that extend about the pipe member and that enable the foot support pad to slide on the pipe members; the pair of substantially vertically disposed post members are each removably attached to the substantially horizontally disposed legs; including a spring interlock for attaching each substantially vertically disposed post member to the substantially horizontally disposed leg; including a step secured between the substantially vertically disposed post members; and including an elongated rail attached to an inner wall of the closet and receiving the inner ends of the support members to enable a sideways sliding of the stool.

In accordance with the present invention there is also provided a method of operating a closet stool in a closet by a user for arranging items stored in the closet, wherein the closet stool includes a pair of support members each having a substantially right angle construction including a substantially horizontally disposed leg having inner and outer ends and a pair of substantially vertically disposed post members each having upper and lower ends with the upper end of each substantially vertically disposed post member engaged with an outer end of the substantially horizontally disposed leg to form the right angle construction; the lower end of each substantially vertically disposed post member for resting on a floor surface of the closet; and a foot support pad that extends between and is supported by the legs, said method comprising: supporting the inner ends of the substantially horizontally disposed leg for movement in a direction that is sideways of the closet and supporting the foot support member for movement in a direction that is orthogonal to the direction of movement of the legs.

DESCRIPTION OF THE DRAWINGS

Numerous other objects, features and advantages of the present invention should now become apparent upon a reading of the following detailed description as taken in conjunction with the accompanying drawings, in which.

DETAILED DESCRIPTION

Figure 17:
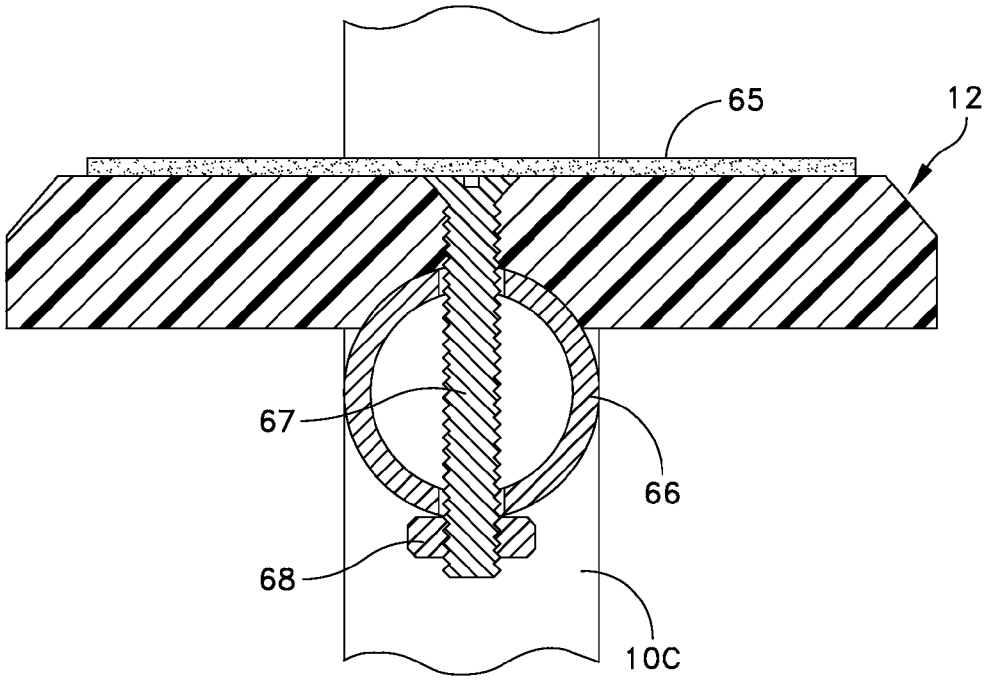
FIG. 17 is a cross-sectional view taken along line 17-17 of FIG. 16.
Figure 18:
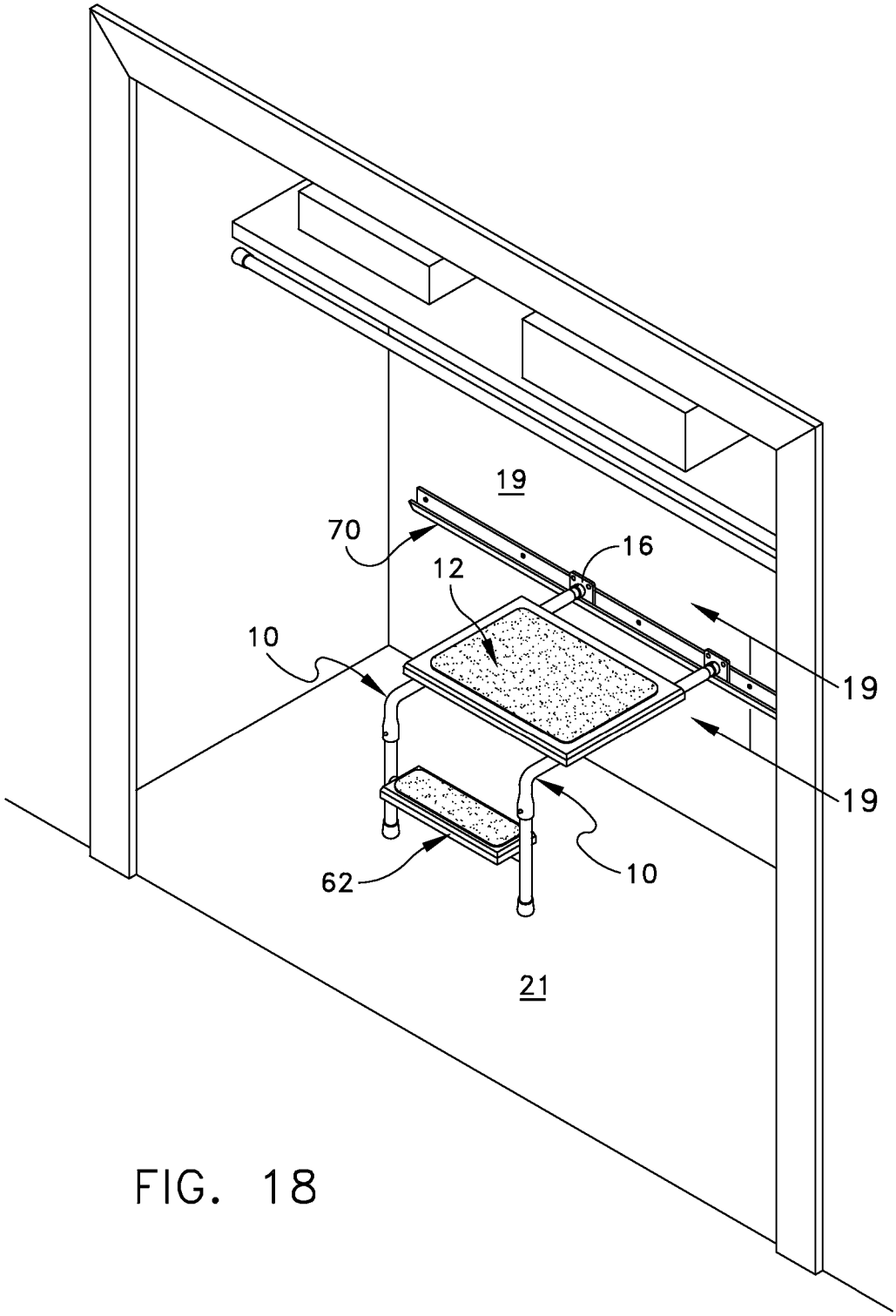
FIG. 18 is a perspective view of a second embodiment of the closet stool of the present invention using an inner mounted rail that enables side-to-side movement of the stool.
Figure 19:
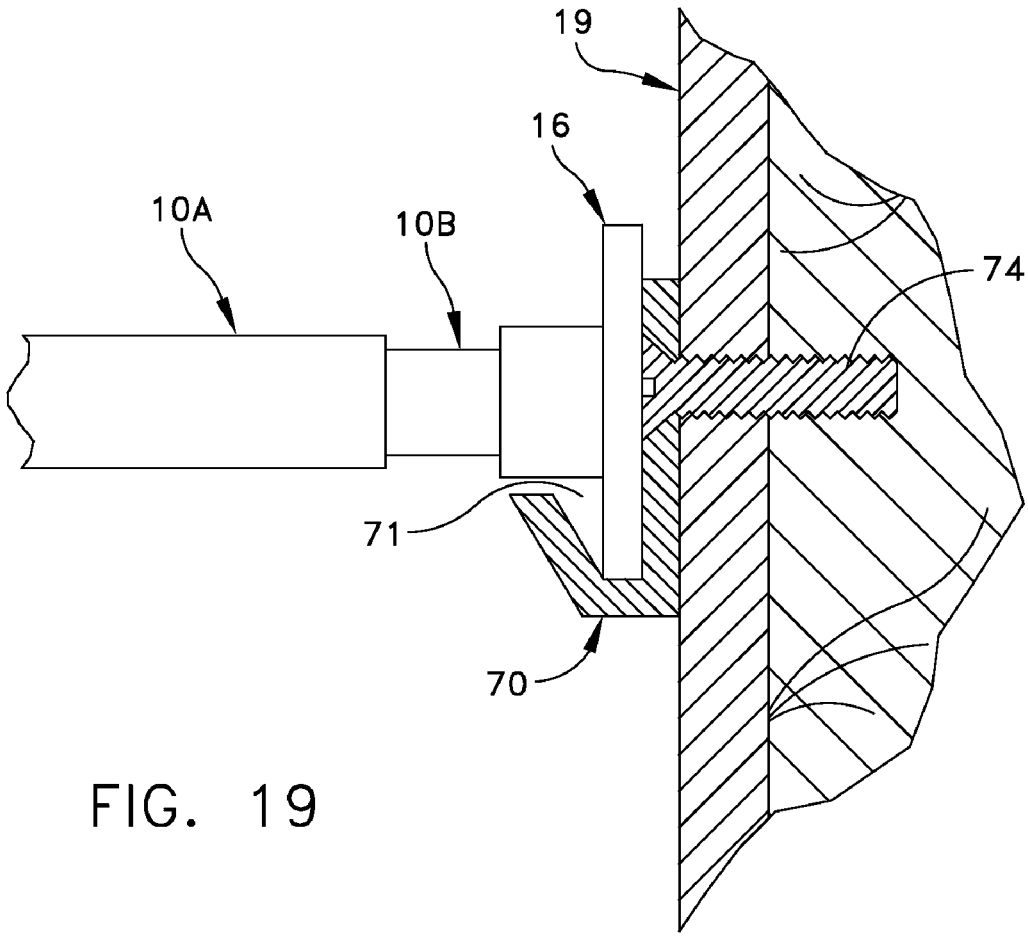
FIG. 19 is a fragmentary view of the interface between the inner end of the support members and the inner rail.
Figure 20:
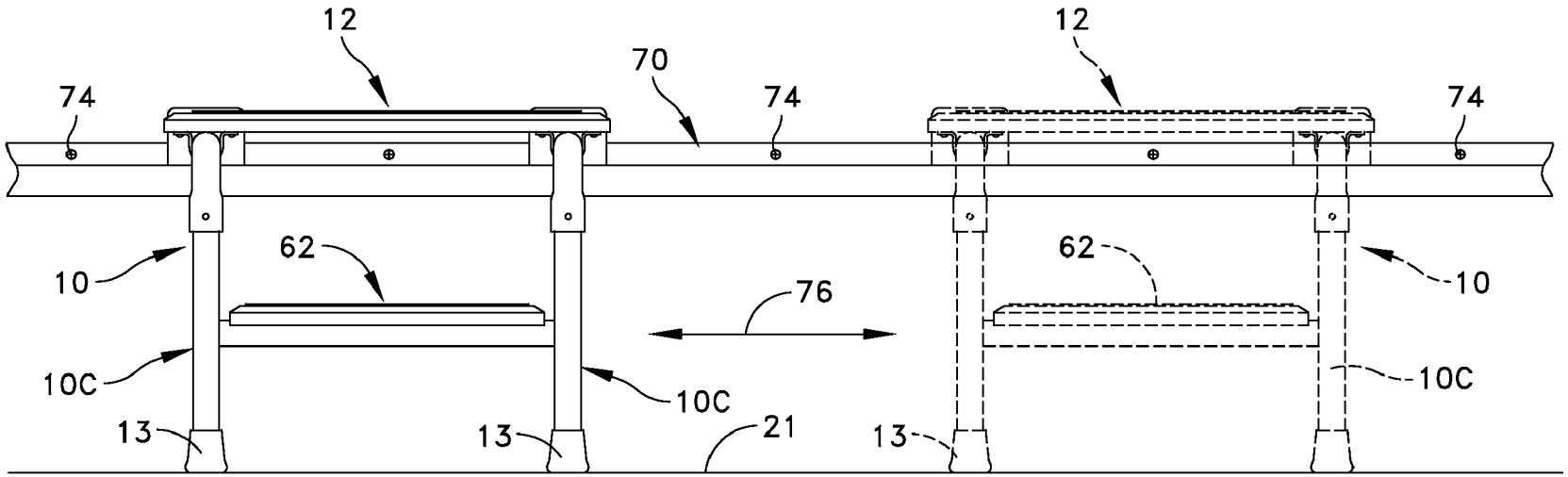
FIG. 20 is a front view illustrating the manner in which the stool can slide sideways in the closet.

Reference is now made to the drawings and at first to FIGS. 1-17 which show a first embodiment of the present invention in which the inner end of each of the support members is fixed in position at a bracket 16. The stool itself may be approximately 16 inches wide and is considered as comprised of two L-shaped support means 10, also referred to herein as respective support members. Various widths may be constructed in accordance with the present invention. A second embodiment of the present invention is illustrated in FIGS. 18-20 wherein the stool can move, not only forward and back in the closet, but also laterally in the closet, so as to provide a closet stool that is universal in its use and can cover virtually the entire inner area of the closet. Both embodiments are relatively simple in construction and can be sold in a compact package that is ready to be assembled. For this purpose the support members 10, as well as the foot support pad 12 and step can be bundled in a compact package. Also, the support member is preferably separable into two pieces, as described in further detail hereinafter.

The closet stool illustrated herein comprises a pair of support members 10 each including a substantially horizontally disposed leg having inner and outer ends and a pair of brackets 16 each for supporting an inner end of the respective substantially horizontally disposed legs from an inner wall 19 of the closet with the legs extending in parallel and spaced from each other. The pair of support members 10 further includes a pair of substantially vertically disposed post members each having upper and lower ends. The upper end of each post member is for coupling with the outer end of a respective leg while the lower end of each post member is for resting on a floor surface 21 of the closet. A foot support pad 12 extends between and is supported by the horizontal legs. The pad 12 is shown as having a layer 15 secured to it. The layer 15 may be a rough surface layer that will prevent the user from slipping when stepping onto the pad 12.

Figure 5:
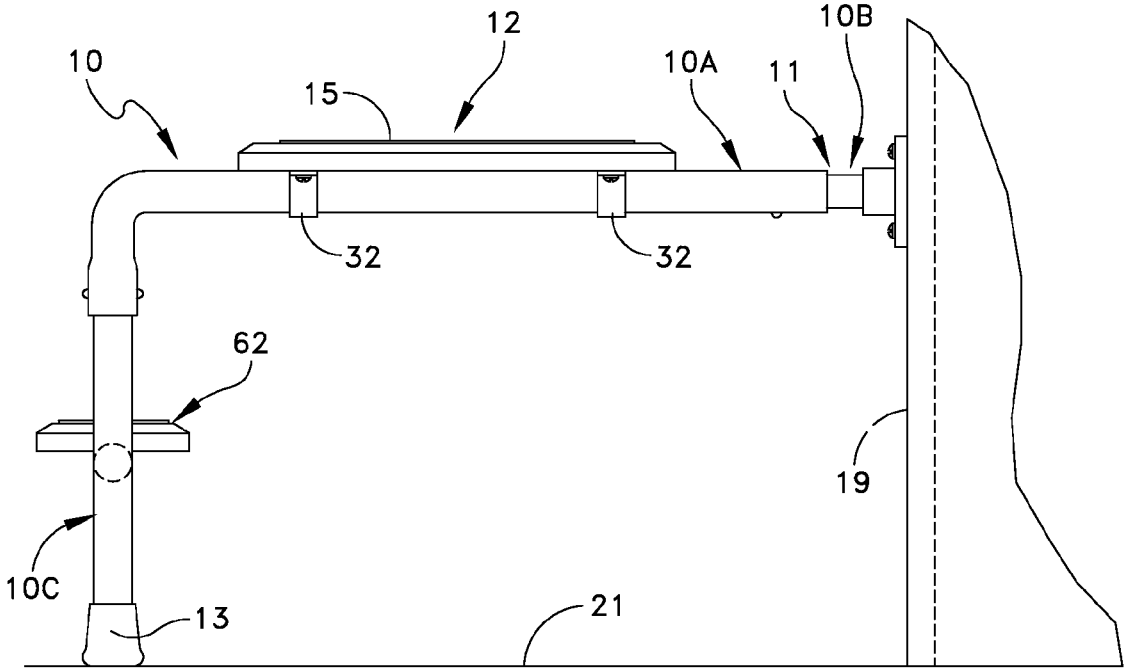
FIG. 5 is a side view of the embodiment illustrated in FIG. 4.
Figure 6:
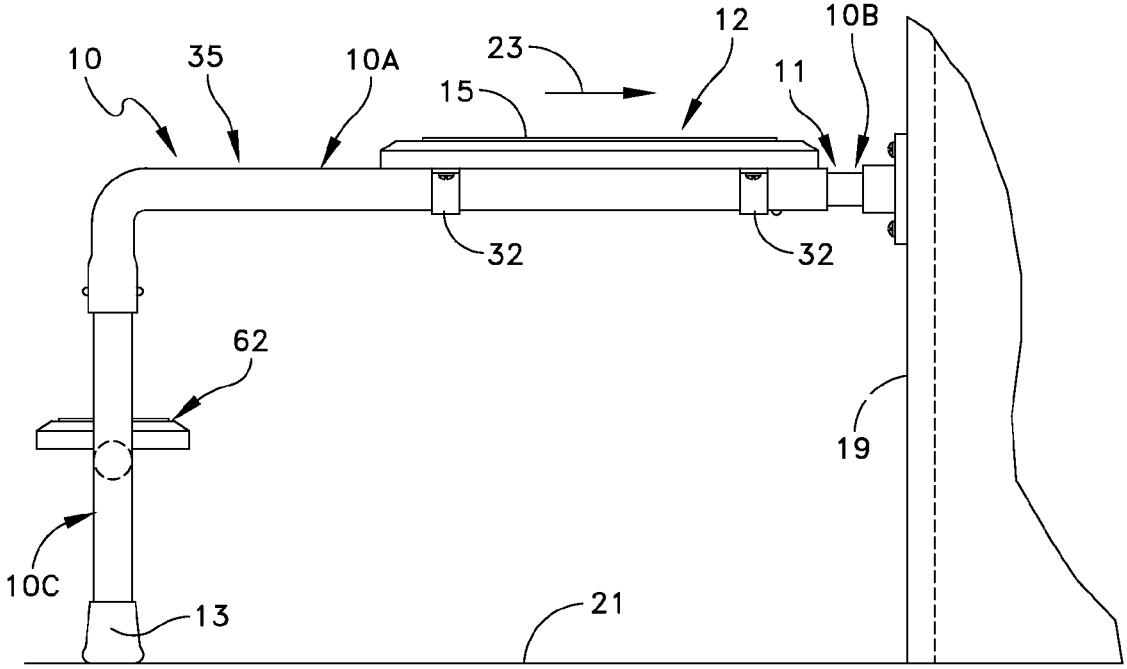
FIG. 6 is a side view like that shown in FIG. 5 with the foot support pad shown slideable.
Figure 7:
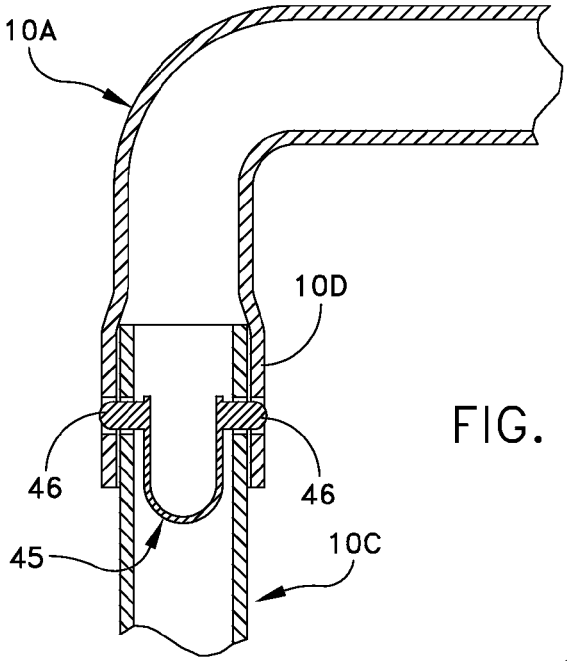
FIGS. 7, 8 and 9 are each partial cross-sectional views illustrating the removable connection between the horizontal leg and vertical post member.
Figure 8:
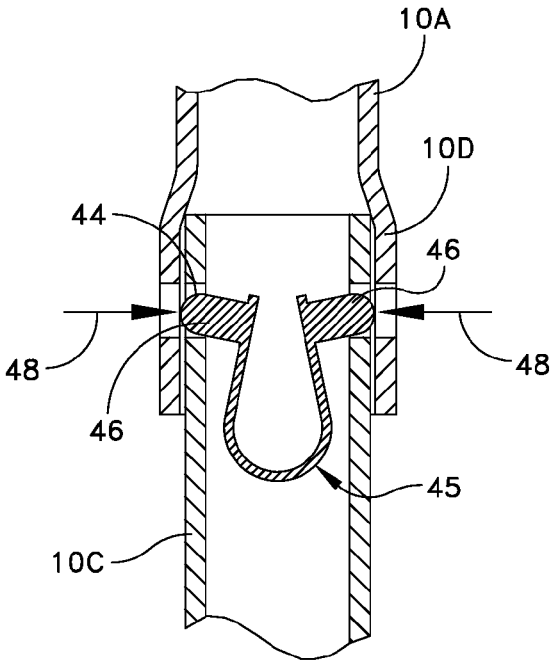
Figure 9:
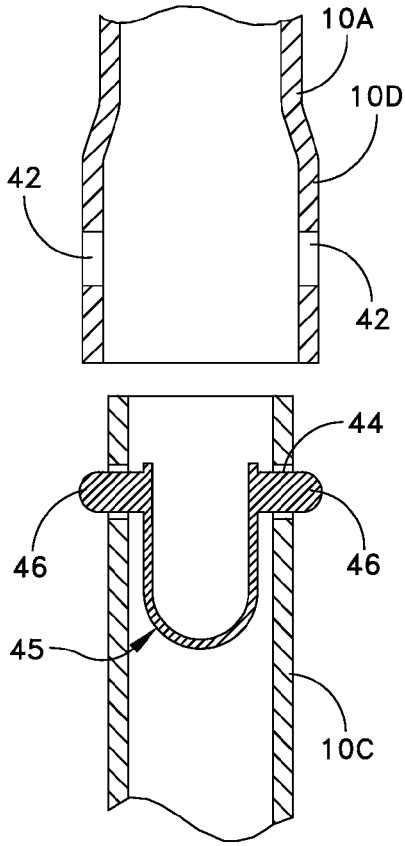
Figure 10:
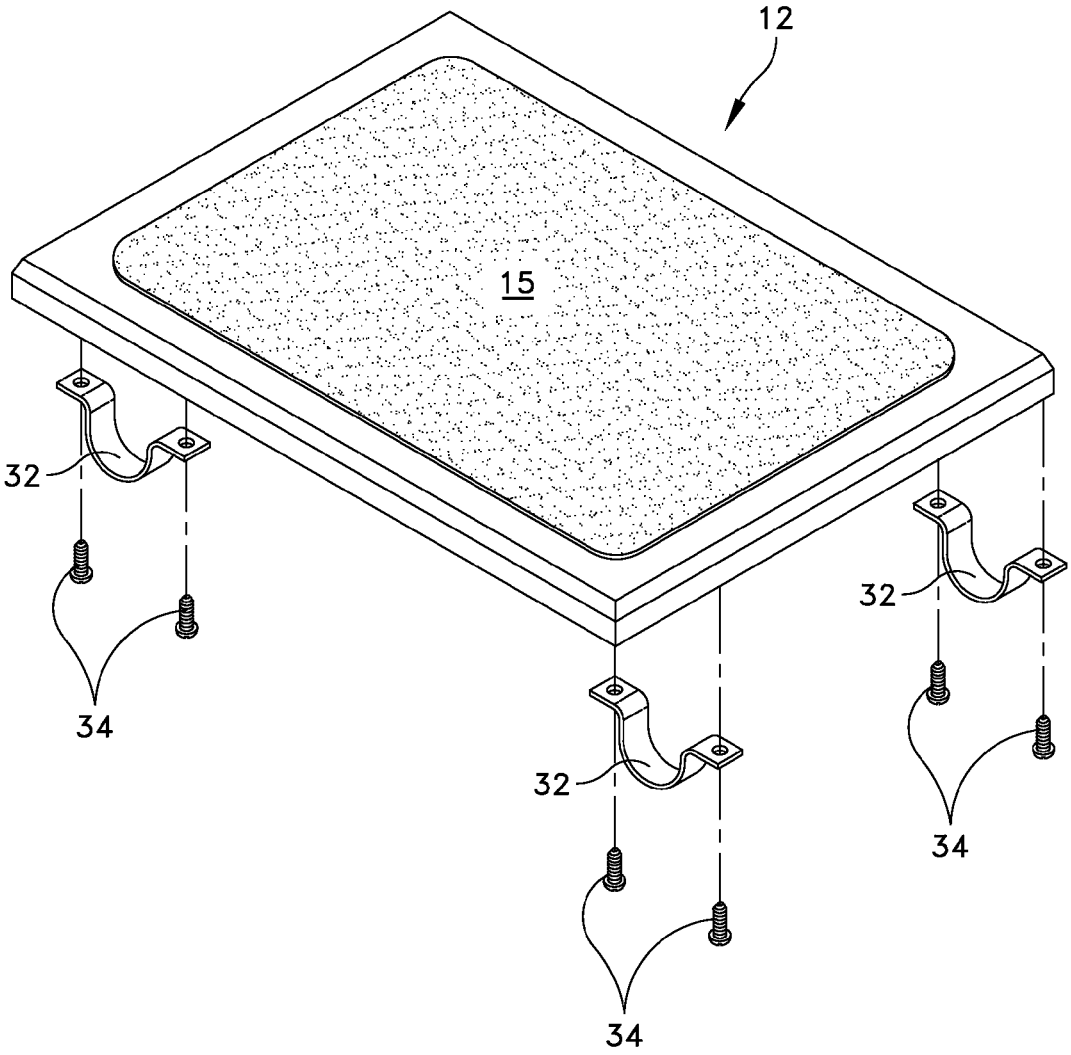
FIG. 10 is an exploded perspective view of the foot support pad.
Figure 11:
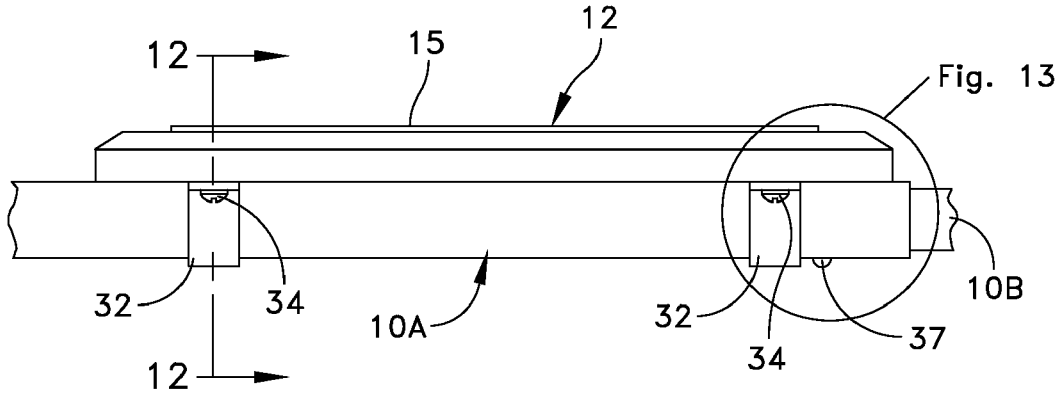
FIG. 11 is a side view of the foot support pad as mounted on the pipe members.
Figure 12:
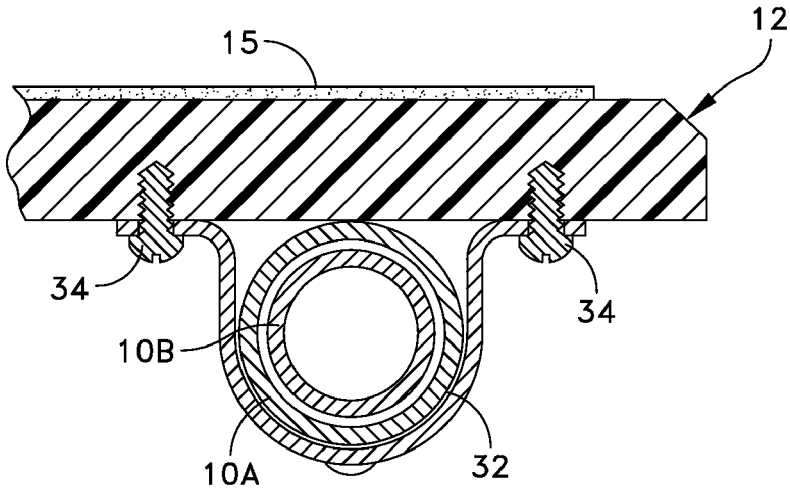
FIG. 12 is a cross-sectional view taken along line 12-12 of FIG. 11.
Figure 13:
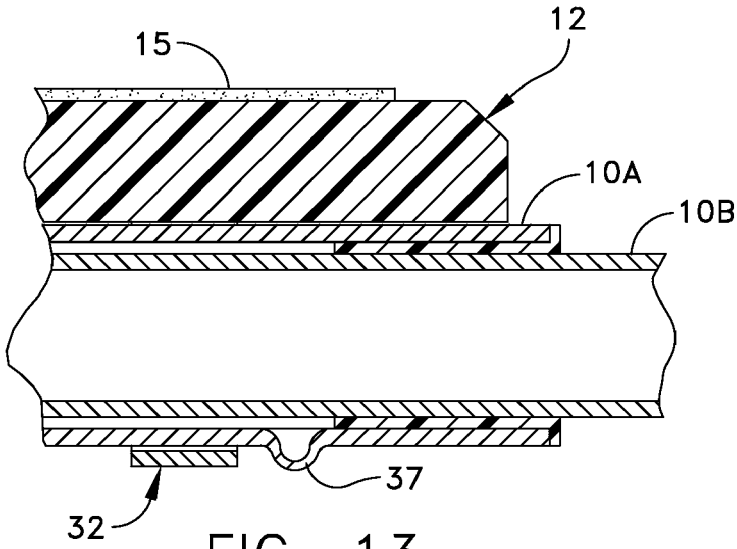
FIG. 13 is a partial cross-sectional view at the foot support pad.

The legs 10 are considered as including basically two leg sections each. These are identified in the drawings as pipe or leg segments 10A and 10B. It is noted that the legs are able to be telescoped as indicated at 11 in, for example, FIGS. 3-6, so that the pipe segment 10A can be slid relative to the longitudinally stationery pipe or leg segment 10B. This is the same on both of the legs 10. In this regard refer to FIGS. 1-4 which show both legs 10 spaced apart from each other and each supported at the wall 19 at the fixed bracket 16. The support members each also include the pair of substantially vertically disposed and upright post members 10C. As the pipe segment 10A moves, such as in the direction indicated by arrow 17 in FIG. 3, so also does the connected post member 10C move therewith. At the bottom of the upright leg 10C there is preferably some type of a cushioning pad at 13 at the bottom thereof. The pad 13 assists in providing a smooth transition in the direction of arrow 17 along the floor 21 in a back to front direction relative to the closet area. The foot support pad 12 is supported from and between respective pipe segments 10A. This foot support pad may be secured such as by being bolted or screwed to the pipe at opposite ends of the pad 12. However, the preferred support of the pad 12 is in a sliding manner as illustrated by the directional arrow 23 in FIG. 6. The pipe segments 10A and 10C may also be attached to each other as shown in FIGS. 7-9 and are preferably fixed in relative position at a 90 degrees angle such as shown in FIGS. 5 and 6.

Figure 3:
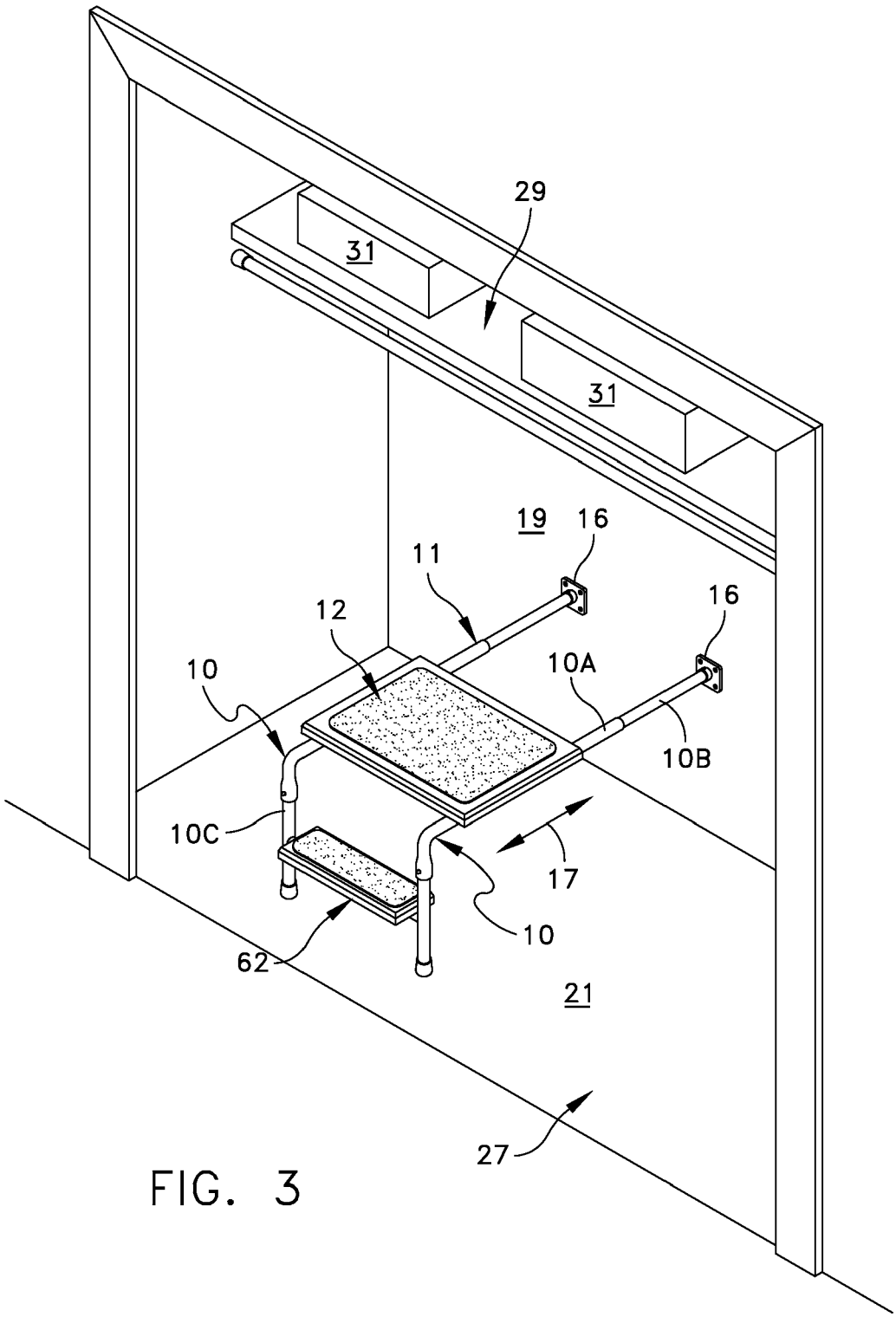
FIG. 3 is a perspective view of the stool construction of the present invention illustrating the ability of the stool to slide in a direction that is in and out of the closet.
Figure 4:
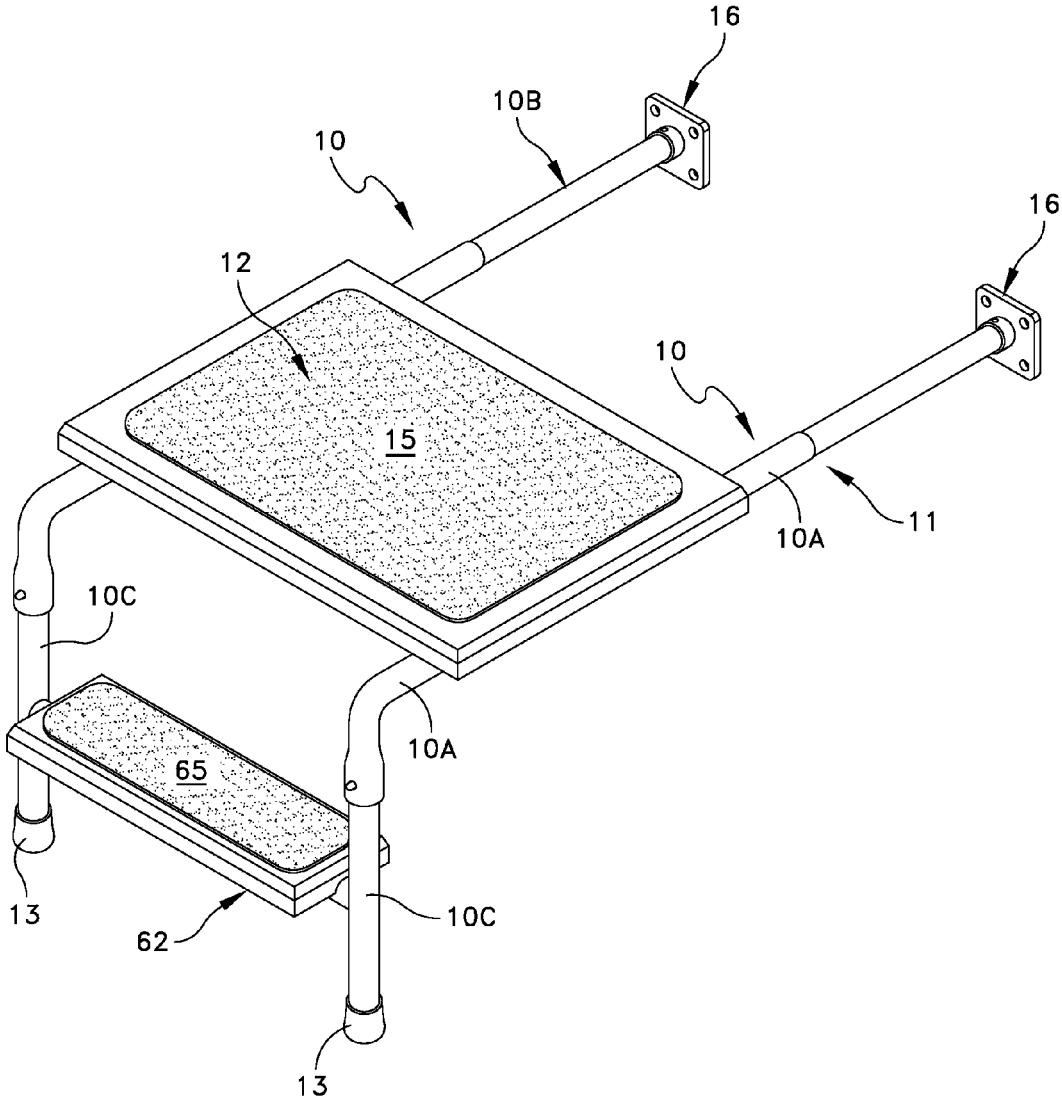
FIG. 4 is a perspective view of the closet stool in the extended position.

In normal operation, the pipe segment 10A is moved telescopically into or around the pipe segment 10B. In the embodiment disclosed herein, the pipe segment 10A is of a larger diameter than the pipe segment 10B and thus the pipe segment 10A is moved about the pipe 10B. This movement is in the direction of arrow 17 as indicated in FIG. 3 so that the stool can either be moved inward to a storage position or outward to a use position. The position of the stool in FIG. 1 may be considered as a storage or stowed position, while the position illustrated in FIG. 3 may be considered as the use position. It is noted that the arrow 17 is double headed to indicate that the stool can be moved between these positions or any positions therebetween. For use in a normal closet, the expanded length of the leg segments 10A and 10B is on the order of 30-36 inches and the length of the post member 10C is preferably on the order of 8-12 inches. The respective support members 10 may be disposed apart by a dimension on the order of 12-18 inches. Each of the inner ends of the pipe sections 10B are attached to the bracket 16 such as by being screwed or bolted to the bracket 16. The bracket 16, in turn, may be affixed to the wall 14 such as by being screwed thereto, as illustrated in more detail in FIGS. 14-15.

Figure 1:
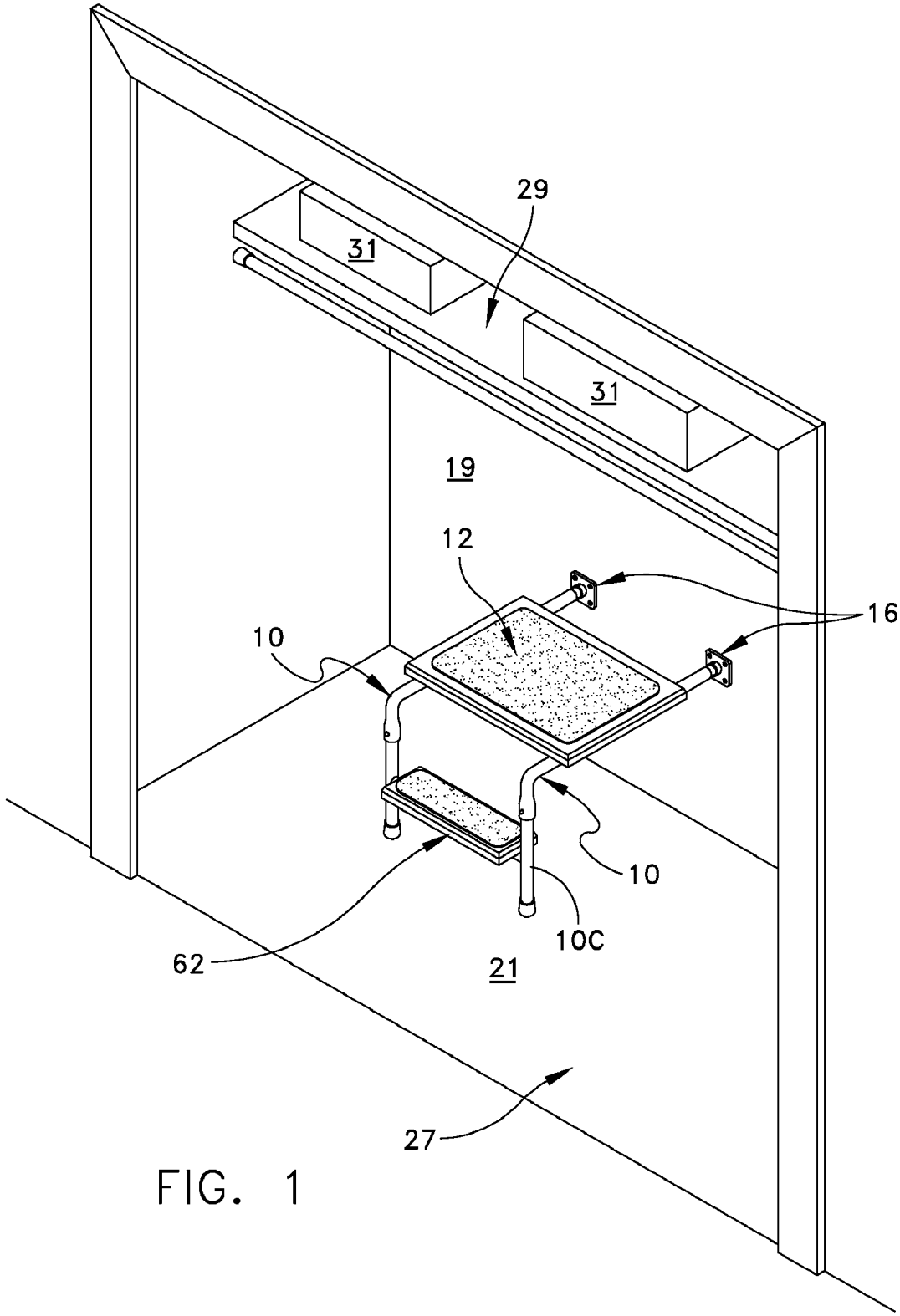
FIG. 1 is a perspective view showing the stool construction of the present invention in a stowed position placed in the closet.
Figure 2:
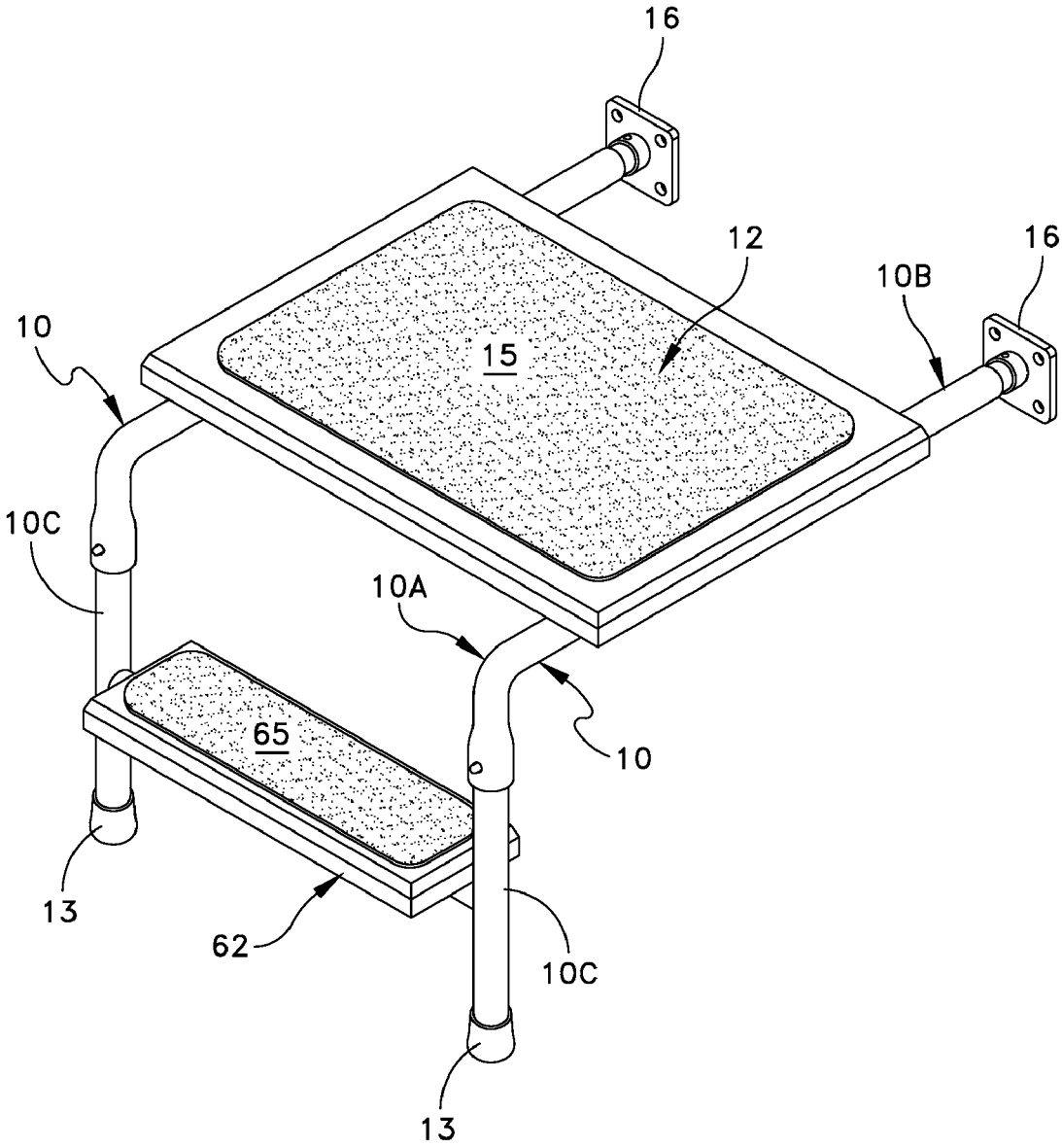
FIG. 2 is a perspective view illustrating the stool construction of the present invention.

In use, when one desires to use the stool, then it is pulled in the direction of arrow 17 outwardly so that the support pad 12 is in a position for use. The user stands on the pad 12. The right angle support members provide more than sufficient strength to support a person. The weight is distributed between the post members and the wall brackets. In this way the user can easily reach overhead items that are typically on a shelf or over a coat rack or the like in the closet. FIGS. 1 and 3 illustrate the closet at 27 with an overhead shelf at 29 that is shown as holding certain items 31. In the stowed position of the stool the foot support pad 12 is preferably under the shelf and out of the way. The stool is then easily slide forward for use.

Not only is the support member slideable, but also the foot support pad 12 itself is slideable in the same direction relative to and on the support members 10, namely in and out of the closet. This is illustrated in FIG. 6 by the directional arrow 23.

Refer also to FIGS. 10-13 for further details of the way that the pad 12 is mounted on the support members 10. The mounting includes loops 32 that are secured to the underside of the foot support pad 12 as clearly shown in the cross-sectional view of FIG. 12. Each of the loops 32 are sized so that there is a loose fit with the pipe segments so that the pad 12 can easily be slid along the pipe segments. By way of example, FIG. 3 shows the foot support pad 12 in a more forward position closer to the respective post members 10C. This would be a position that is convenient for stepping on the pad. On the other hand the pad 12 can be moved inwardly, such as to the position shown in FIG. 6, thus providing an access opening at 35. This is an opening between the support members 10. This enables a user to be able to store additional items in the floor space below the opening 35. Also the sliding arrangement preferably has a stop, illustrated by the protrusion 37 from the segment 10A in FIG. 13. This protrusion limits the extent to which the foot support pad can slide on the support members 10 in a rearward direction.

Reference is now made to FIGS. 7-9 for further details of the manner in which the support members 10 are attached to the post member. This by a releasable arrangement so that the pipe segment 10A can be readily secured to or detached from the post member 10C. As illustrated, the outer end of the pipe segment 10A is formed at a right angle with an enlarged end 10D with a pair of opposed through holes 42. Similarly, the upper end of each of the post members 10C have opposed holes 44 that can be aligned with the holes 42, as illustrated in FIG. 8. A butterfly snap 45 is disposed within the post member 10C and positioned so that tabs 46 can engage with both sets of holes 42, 44. To engage and disengage the post member and pipe segment one simply pushes on the tabs 46 in the direction of arrows 48 in FIG. 8. FIG. 9 shows the members not yet engaged. FIG. 8 shows the tabs actuated with the holes 42, 44 aligned. FIG. 7 shows the final interlocked position of the post members 10C with the support members. From the position of FIG. 7 one can simply push the tabs inwardly to disengage the post member and pipe segment.

Figure 14:
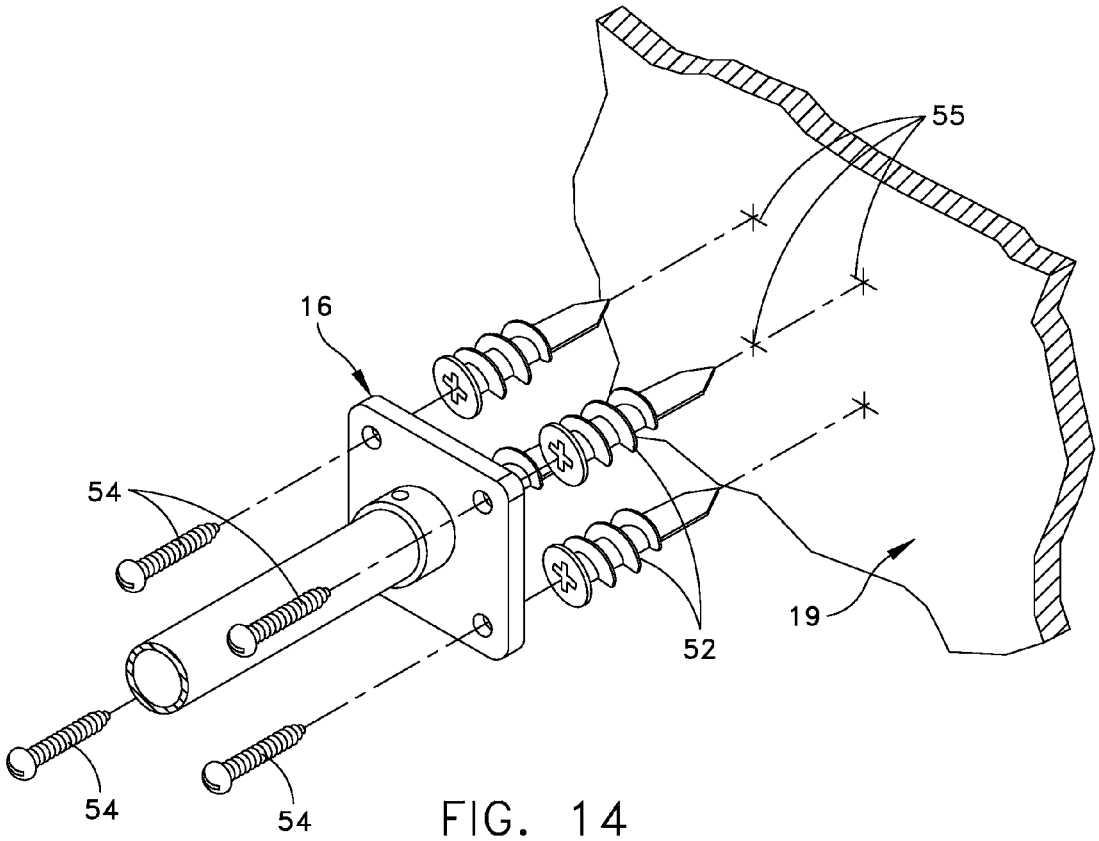
FIG. 14 is an exploded perspective view at the mounting bracket.
Figure 15:
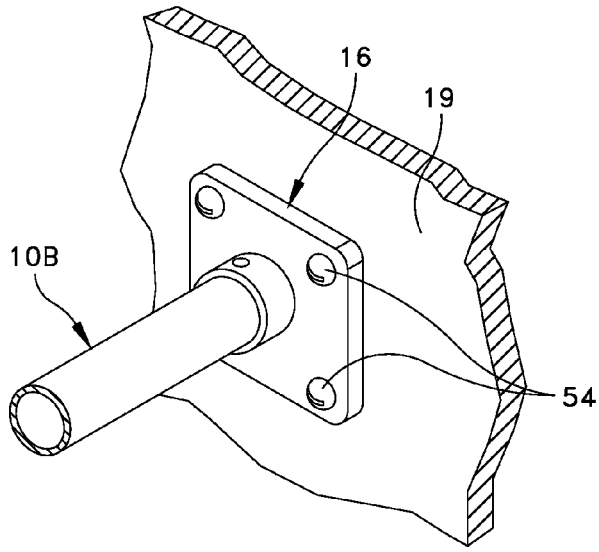
FIG. 15 illustrates the bracket mounted to the inner wall of the closet.

Reference is now made to FIGS. 14 and 15 for further details of the manner in which the bracket 16 can be permanently secured to the closet wall 19. Any number of different types of securing means can be used. There is illustrated as a plurality of fasteners 52 that can be screwed into the wall board at the locations 55. These particular fasteners are constructed to receive screws 54. FIG. 14 shows the different components in an exploded view while FIG. 15 shows the assembled arrangement. Other types of fasteners can also be employed either in alignment at an internal wall stud or directly into the wall board between studs.

Figure 16:
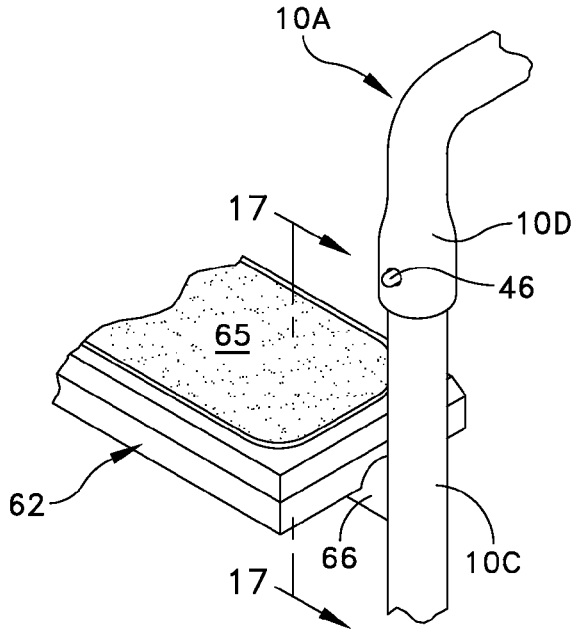
FIG. 16 is a partial perspective view of the stool at the step area.

The closet stool of the present invention is also preferably provided with at least one step 62 that is secured between the upright post members 10C. FIGS. 16 and 17 show one way that the step can be secured. The step is also shown as having a layer 65 secured to it. The layer 65 may be a rough surface layer that will prevent the user from slipping when stepping onto the step 62. To support the step a cross piece 66 may be provided that is secured at its opposite ends to the respective post members 10C. The cross-sectional view of FIG. 17 shows the use of one or more bolts 67 and associated nuts 68 extending through the step 62 and cross piece 66 to mount the step 62 in a horizontal position. Preferably at least two bolts 67 are uses at either end of the cross piece 66.

The first embodiment illustrated in FIGS. 1-17 has the support members fixed at the wall 19. However, the preferred manner for securing the support members 10 includes a separate rail bracket 70. This second embodiment is illustrated in FIGS. 18-20. In FIGS. 18-20 the same reference numbers are used as referenced in the first embodiment as many of the components can be substantially the same as in the first embodiment. For this embodiment FIG. 18 is a perspective view of the closet stool of the present invention using an inner mounted rail that enables side-to-side movement of the stool. FIG. 19 is a cross-sectional fragmentary view of the interface between the inner end of the support members and the inner rail. FIG. 20 is a front view illustrating the manner in which the stool can slide sideways in the closet.

The bracket 70 defines a groove 71 in which the inner end of each of the pipe segments 10B can rest, particularly at each respective bracket 16. The cross-sectional view of FIG. 19 illustrates the elongated rail 70 that is secured to the inner wall 19 by means of screws or the like, such as by the illustrated screw 74 in FIG. 19. FIG. 19 also shows the bracket 16 seated in the groove 71 in the rail 70. Various types of interlocks may be provided between the bracket and rail, as long as the interface allows an easy sliding action of the stool in a direction longitudinally along the rail 70. The rail 70 may extend along virtually the entire width of the closet wall, or may extend along only a portion of the inner wall of the closet. The brackets may be provided with various types of interlocking arrangements relative to the rail 70 including some type of a downwardly turned end that matches with and engages with the groove 71 in the rail 70. In this way, the stool can simply rest on the bracket rail 70 without being fixed to the bracket rail 70. This enables the feature of the present invention which is the ability of the stool to slide in the direction of arrow 76 in FIG. 20 from side to side to reposition the stool so that, for example, in a wide closet the stool can be moved to different positions to provide access to different areas of the overhead space.

The rail 70 preferably is of elongated shape and, as indicated previously, defines some type of a groove or other interlock arrangement so that the inner end of each of the spaced support members can be set in the rail 70 for support thereof and yet at the same time allow a transition of the entire support members in the direction of arrow 76 so that the stool can essentially be moved laterally along the inner wall of the storage area.

Accordingly, in accordance with the present invention there is provided a stool arrangement that has the feature of telescoping the legs so that they can be moved inward to a storage position and pulled outwardly to a use position such as illustrated in FIGS. 1 and 3. Moreover, by providing an elongated bracket for the support of the inner sides of the support members, one can also provide a stool construction that can essentially slide along the inner wall of the storage area so that the stool can be repositioned to any position along the bracket 20. In this regard, refer to FIG. 20 which shows two possible positions, one in solid outline and the other in dotted outline. The rail 20 preferably has a length substantially longer than the spacing between the support members 10. Furthermore, the foot support pad is mounted in a manner that allows the pad to slide along the support members 10 to properly position and foot support pad 12.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. A closet stool for use in providing access by a user to items stored in the closet, said closet stool mounted in combination with a rear closet wall and comprising:

a pair of support members each including a substantially horizontally disposed leg having inner and outer ends;

the substantially horizontally disposed leg being constructed of separate telescoping tubular pipe sections that enable the support members to be slid in a direction in and out of the closet;

said telescoping tubular pipe sections including an inner tubular pipe segment and an outer tubular pipe segment that has a diameter greater than the diameter of the inner tubular pipe segment so that the inner pipe segment is slidable in the outer tubular pipe segment;

a pair of brackets each for supporting an inner end of the respective inner tubular pipe segments from the rear wall of the closet with the legs extending in parallel and spaced from each other;

said pair of support members further including a pair of substantially vertically disposed post members each having upper and lower ends;

a pair of releasable interlock mechanisms for attaching the upper end of each substantially vertically disposed post member to the substantially horizontally disposed leg;

the lower end of each post member for resting on a floor surface of the closet;

and a foot support pad that extends between and is supported by the outer pipe segments;

said telescoping tubular pipe sections having a stored position and a fully deployed position in which said foot support pad is disposed farther away from and a maximum distance away from said wall brackets than in the stored position thereof;

the combined length of the inner and outer tubular pipe segments being on the order of 30-36 inches in the fully deployed position;

said substantially horizontally disposed legs disposed in parallel and spaced apart by a dimension on the order of 32-18 inches;

said foot support pad being rectangular in shape having opposed sides and orthogonally disposed opposed front and rear edges;

said foot support pad having a width as measured in a direction between the legs and between opposed sides of the foot support pad, and having a depth as measured between front and rear edges of the foot support pad;

the depth of the foot support pad being less than a spacing between the rear edge of the foot support pad and the closet rear wall in the fully deployed position of the telescoping tubular pipe sections when said foot support pad is disposed a maximum distance away from said rear closet wall;

a set of spaced apart support loops that are attached to the foot support pad at opposite sides thereof and that each extend about the outer tubular pipe segment for securing the foot support pad to the outer tubular pipe segments;

the support loops including two support loops for mating with one of the outer tubular pipe segments and two other support loops for mating with the other outer tubular pipe segment;

each of the support loops including a U-shaped center section and opposed flat ends contiguous with the U-shaped center section, each flat end having a hole therein;

multiple pairs of screws, each pair for retaining one of the support loops, one screw passing through each hole in the flat ends of the support loop for holding each support loop to an underside of the foot support pad;

and a step fixedly secured between the substantially vertically disposed post members.

2. The closet stool of claim 1 including an elongated rail attached to an inner wall of the closet and receiving the inner ends of the support members to enable a sideways sliding of the stool.

* * * * *